US006039008A

United States Patent [19]

Anderson et al.

[11] Patent Number: 6,039,008

[45] Date of Patent: Mar. 21, 2000

[54] STEAM GENERATOR HAVING AN IMPROVED STRUCTURAL SUPPORT SYSTEM

[75] Inventors: David K. Anderson, East Longmeadow, Mass.; John H. Chiu, West Hartford; Steven F. McNary, North Granby, both of Conn.; Nicole M. Phyfe, West Lebanon, N.H.; David G. Turek, South Windsor; Donald G. Mylchreest, Simsbury, both of Conn.

[73] Assignee: Combustion Engineering, Inc., Windsor, Conn.

[21] Appl. No.: 09/241,158

[22] Filed: Feb. 1, 1999

[51] Int. Cl.[7] ..... F22B 37/24

[52] U.S. Cl. ..... 122/510; 122/4 D; 122/7 R

[58] Field of Search ..... 122/510, 4 D, 122/7 R, 1 A, DIG. 1, DIG. 2; 432/58, 15; 110/245

[56] References Cited

U.S. PATENT DOCUMENTS 5,551,381 9/1996 Losel et al. ..... 122/510

*Primary Examiner*—John A. Jeffery
*Assistant Examiner*—Jiping Lu
*Attorney, Agent, or Firm*—Russell W. Warnock

[57] ABSTRACT

There is provided a circulating fluidized bed steam generator (CFB) having an improved structural support system and an improved combined hot solids-gas separator for separating gas and solids from a combined gas-solids stream. The combined hot solids-gas separator is in the form of a cyclone assembly having a plurality of wall portions forming a separation chamber and an inlet for passage of a combined gas-solids stream into the separation chamber. The lowermost extent of the inlet forms a threshold over which the combined gas-solids stream flows in entering the separation chamber. The separation chamber is operable to separate the combined gas-solids stream into a predominantly gas exit stream and a predominantly solids exit stream in a manner by which separated out solids to be discharged from the separation chamber via the predominantly solids exit stream are collected within the separation chamber at a location lower than the inlet. The cyclone assembly further includes a separated solids discharge for the discharge therethrough of the predominantly solids exit stream having the collected separated out solids therein and a gas outlet duct for outward flow of the predominantly gas exit stream out of the separation chamber.

9 Claims, 11 Drawing Sheets

STEAM GENERATOR HAVING AN IMPROVED STRUCTURAL SUPPORT SYSTEM

BACKGROUND OF THE INVENTION

The present invention relates to a steam generator having an improved structural support system and an improved combined hot solids-gas separator for separating gas and solids from a combined gas-solids stream and, more particularly, to a circulating fluidized bed steam generator (CFB) having an improved structural support system and an improved combined hot solids-gas separator.

Steam generators including circulating fluidized bed steam generators can achieve a substantial size requiring commensurately substantial structural support systems. U.S. Pat. No. 4,286,549 to Eisinger illustrates one variation of a common structural support system known as a top support system in which the steam and heat cycle components are suspended from a structural support frame which permits thermal expansion of these components during their operation. Such structural support frames include vertical post members disposed adjacent front, rear, and sides of the overall configuration of the steam and heat cycle components and a plurality of laterally extending members above this overall configuration. A plurality of tie rods mounted to the laterally extending members extend vertically to connect to the steam and heat cycle components so as to thereby suspend these components from the laterally extending members of the structural support system.

U.S. Pat. No. 4,745,884 to Coulthard discusses some of the drawbacks associated with top support systems due to, among other reasons, the separation and spaced-apart location of the various components. Also, the impact of the use of refractory materials is noted therein including the impact on the weights of the components and the impacts on maintenance procedures and schedules for completing and maintaining an operative system. These various impacts make it generally desirable to minimize the amount of refractory material used. Another drawback noted in the Coulthard reference is the differential thermal movements between component parts which engender commensurate reinforcement of the structural support system—with attendant weight and material cost increases of the support system. Accordingly, the need exists for a steam generator whose individual components can be relatively closely positioned to one another while minimizing the demands placed upon the structural support system which supports the individual components relative to one another.

Additionally, steam generators such as circulating fluidized bed steam generators typically employ mechanical separators for separating from one another two constituent elements of the flue gas produced by the combustion process—namely, hot solids and gas. One type of separator for separating solids and gases in a combined solids-gas stream has been characterized as a cyclone separator due to the fact that it typically comprises a vertical cylindrical separation chamber having a lower end of diminishing horizontal cross-section. Typically, hot flue gases which have exited a furnace volume of a solids recirculating type of fossil fuel-fired system are flowed into the upper region of the cyclone separator. In the cyclone separator, the different influences of centrifugal force on the solids in comparison with the gases are capitalized upon to create a downward movement of the solids while the gases are drawn into a swirl or vortex movement. Ultimately, a relatively large fraction of the solids move downwardly into a discharge or collections region at the base of the cyclone separator.

Cyclone separators have been designed with a gas outlet duct extending downwardly through a top wall of the separation chamber to a location at which the gases moving in the vortex now enter the gas outlet duct and exit the cyclone separator. Cyclone separators have also been proposed with a gas outlet duct extending upwardly through a bottom wall of the separation chamber. For example, U.S. Pat. No. 4,874,584 to Ruottu discloses a cyclone separator in which the gases flowing tangentially from the upper part of a fluidized bed reactor are discharged through a discharge pipe going through the bottom of the vortex chamber.

The Ruottu patent discloses that its cyclone separator arrangement provides some advantages over conventional cyclone separator arrangements such as, for example, the advantage that the axial and radial velocities prevailing in the lower part of its disclosed flow-through reactor are low, but the tangential velocity is high. Thus, according to the Ruottu patent, dust entrained by an eventual suction flow cannot get into the discharge pipe but is separated onto the walls and returned to the fluidized bed reactor.

Notwithstanding the alleged advantages of a cyclone separator arrangement having a downwardly exiting gas discharge pipe, there has been an unmet need for proposals of an arrangement which might capture these advantages without disproportionately sacrificing the advantages provided by the conventional top exiting gas discharge pipe arrangements. For example, it would be a beneficial contribution to the cyclone separator art if an arrangement were to be provided which maintains or even increases the separation efficiency of the separator while improving up to optimizing the vortex flow of the gases in the separator.

SUMMARY OF THE INVENTION

The present invention advantageously provides a steam generator whose individual components can be relatively closely positioned to one another while minimizing the demands placed upon the structural support system which supports the individual components relative to one another. In particular, the present invention provides a circulating fluidized bed steam generator having a structural support system which supports individual steam and heat cycle components relatively closely adjacent one another while minimizing the structural support demands.

Moreover, the present invention provides a steam generator having a combined hot solids-gas separator arrangement for separating gas and solids from a combined gas-solids stream which offers the advantages of a bottom exiting gas discharge pipe while ensuring a stability and reliability of operation as favorable as conventional separator arrangements having top exiting gas discharge pipes.

In accordance with one aspect of the present invention there is provided a steam generator for generating steam by the combustion of a fuel. The steam generator includes the basic components of a combustion chamber, a hot solids-gas separator, heat exchanger means, and a support structure. The hot solids-gas separator has a gas outlet duct for outward flow of the predominantly gas exit stream out of the separation chamber, the gas outlet duct having at least one entrance within the separation chamber for the passage of the predominantly gas exit stream thereinto and the gas outlet duct having an extent from at least its entrance to an exterior interface between the gas outlet duct and the separation chamber beyond which the gas outlet duct is communicated with an area exterior of the separation chamber. The separator is disposed on one lateral side of the combustion chamber and has a chamber side face in facing relation to the combustion chamber, the chamber and the separator each having a predetermined lateral extent.

The heat exchanger means is operable to receive cleaned gas which has exited the hot solids-gas separator through the gas outlet duct, the heat exchanger means having a principal heat exchange region defined by that portion of the heat exchanger means in which more than half of the heat exchange duty of the heat exchange means is performed. The principal heat exchange region has a predetermined lateral extent and a center of gravity. The center of gravity is at a lateral spacing from a chamber side face of the hot solids-gas separator no greater than one hundred and twenty five percent (125%) of the predetermined lateral extent of the hot solids-gas separator and has a height as measured in a longitudinal direction perpendicular to the lateral direction no higher than the exterior interface of the gas outlet duct of the hot solids-gas separator.

The support structure is operable to support the steam generating apparatus and includes a load bearing assembly for supporting the hot solids-gas separator. The support structure is characterized by the absence of any load bearing members for supporting heat exchange surface which support heat exchange surface (a) at a height greater than the height of the exterior interface of the gas outlet duct of the hot solids-gas separator and (b) within a predetermined lateral extent extending from a location on the hot solids-gas separator laterally opposite the chamber side face thereof to a width no greater than the lateral extent of the hot solids-gas separator.

In accordance with another aspect of the present invention, there is provided, for a circulating fluidized bed steam generator (CFB), a combined hot solids-gas separator for separating gas and solids from a combined gas-solids stream. Preferably, the combined hot solids-gas separator is in the form of a cyclone assembly having a plurality of wall portions forming a separation chamber and an inlet for passage of a combined gas-solids stream into the separation chamber.

According to one feature of the another aspect of the present invention, the lowermost extent of the inlet forms a threshold over which the combined gas-solids stream flows in entering the separation chamber. Additionally, the separation chamber is operable to separate the combined gas-solids stream into a predominantly gas exit stream and a predominantly solids exit stream in a manner by which separated out solids to be discharged from the separation chamber via the predominantly solids exit stream are collected within the separation chamber at a location lower than the inlet.

The cyclone assembly further includes a separated solids discharge for the discharge therethrough of the predominantly solids exit stream having the collected separated out solids therein and a gas outlet duct for outward flow of the predominantly gas exit stream out of the separation chamber. According to a further feature of the another aspect of the present invention, the gas outlet duct has at least one entrance within the separation chamber for the passage of the predominantly gas exit stream thereinto. Additionally, the gas outlet duct has an extent from at least its entrance to an exterior interface between the gas outlet duct and the separation chamber beyond which the gas outlet duct is communicated with an area exterior of the separation chamber. The gas outlet duct is operable to exert a vortex effect capable of drawing gas into the gas outlet duct. Moreover, according to an additional feature of the another aspect of the present invention, the threshold of the separation chamber inlet is relatively higher than the exterior interface of the gas outlet duct and the separation chamber and relatively lower than the entrance of the gas outlet duct.

In one variation of the cyclone separator assembly of the present invention, the extent of the gas outlet duct is substantially without openings below the entrance so as to effectively preclude the entrance of gas into the gas outlet duct below the entrance. In another variation of the cyclone separator assembly of the present invention, the entrance of the gas outlet duct is formed by a selective barrier portion extending from the gas outlet duct to one of the wall portions of the separation chamber. Preferably, the selective barrier portion has a peripheral extent formed by a plurality of spaced apart slats with each adjacent pair of slats forming an opening therebetween.

In a further variation of the cyclone separator assembly of the present invention, one of the wall portions forming the separation chamber is disposed at a spacing from and above the entrance of the gas outlet duct and further comprising a vortex enhancement element extending from the one wall portion toward the gas outlet duct and having a peripheral extent substantially aligned and compatibly dimensioned with the peripheral extent of the gas outlet duct, whereby the vortex enhancement element cooperates with the gas outlet duct to promote the formation of a vortex action within the gas outlet duct.

In a further additional variation of the cyclone separator assembly of the present invention, the separation chamber inlet includes an upper surface in opposition to, and spaced from, its threshold, and the entrance of the gas outlet duct is located no higher than the upper surface of the separation chamber inlet.

Moreover, in yet another variation of the cyclone separator assembly of the present invention, the separation chamber inlet includes an upper surface in opposition to, and spaced from, its threshold, and the entrance of the gas outlet duct is located relatively higher than the upper surface of the separation chamber inlet. In this variation, one of the wall portions forming the separation chamber is preferably disposed at a spacing from and above the entrance of the gas outlet duct and the entrance of the gas outlet duct is preferably located at a height differential above the threshold of the separation chamber inlet which is at least one half of the height differential between the one wall portion above the entrance of the gas outlet duct and the threshold of the separation chamber inlet.

DETAILED DESCRIPTION OF THE PREFERRED EMBODIMENTS

Figure 7:
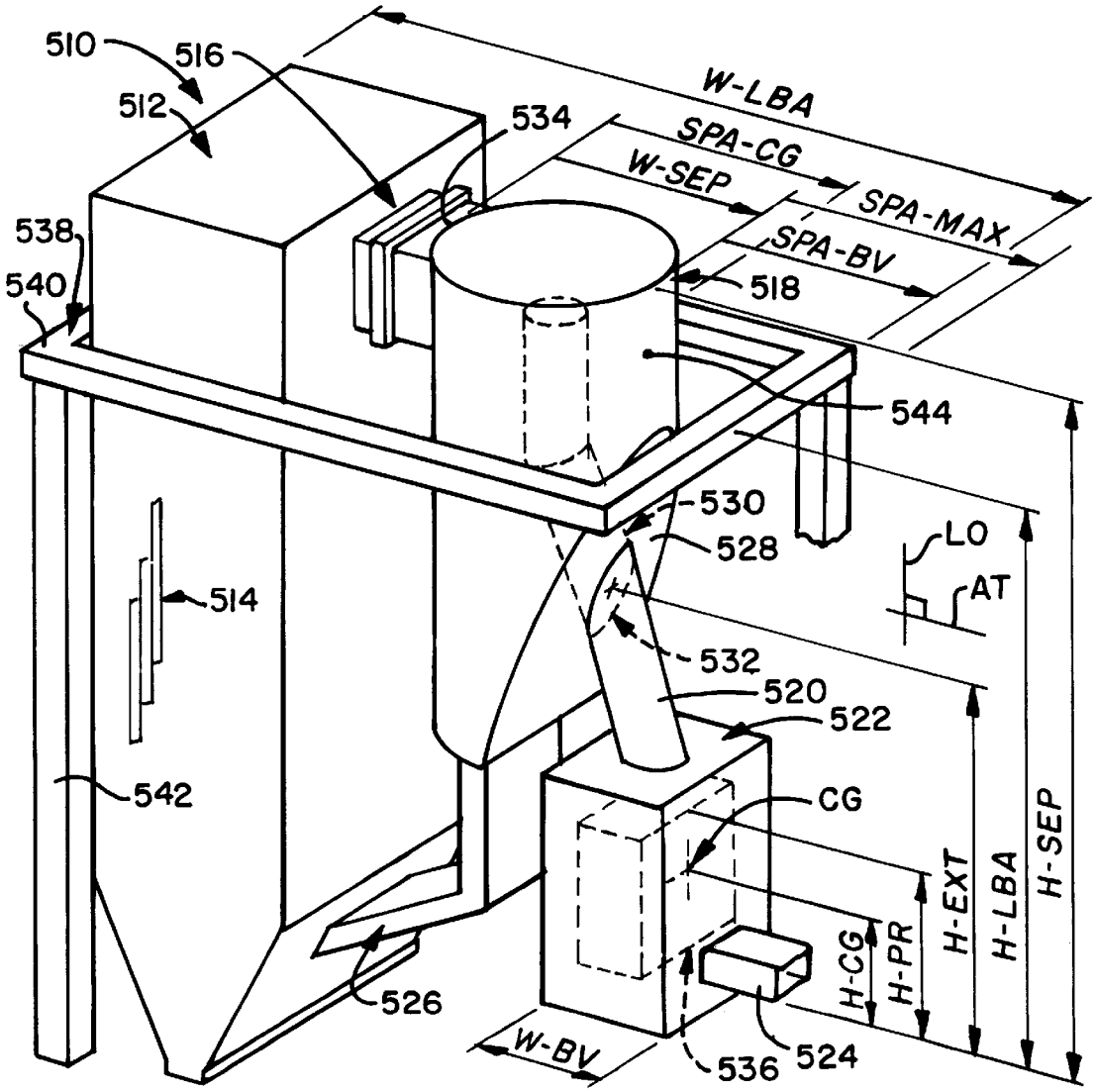
FIG. 7 is a perspective schematic view of another embodiment of a circulating fluidized bed steam generator in accordance with the present invention.

Referring now to FIG. 7 of the drawings, there is depicted therein an embodiment of a circulating fluidized bed steam generator having the improved structural support system as well as the improved hot solids-gas separator of the present invention. The circulating fluidized bed steam generator (CFB), generally designated by the reference numeral 510, advantageously provides an arrangement in which the individual steam and heat components are supported relatively closely adjacent one another while minimizing the demands on the structural support system which supports these components. However, before providing a detailed description of the circulating fluidized bed steam generator 510, reference will first be had to FIGS. 1 and 2 of the drawings to provide a general description of a circulating fluidized bed steam generator.

Figure 1:
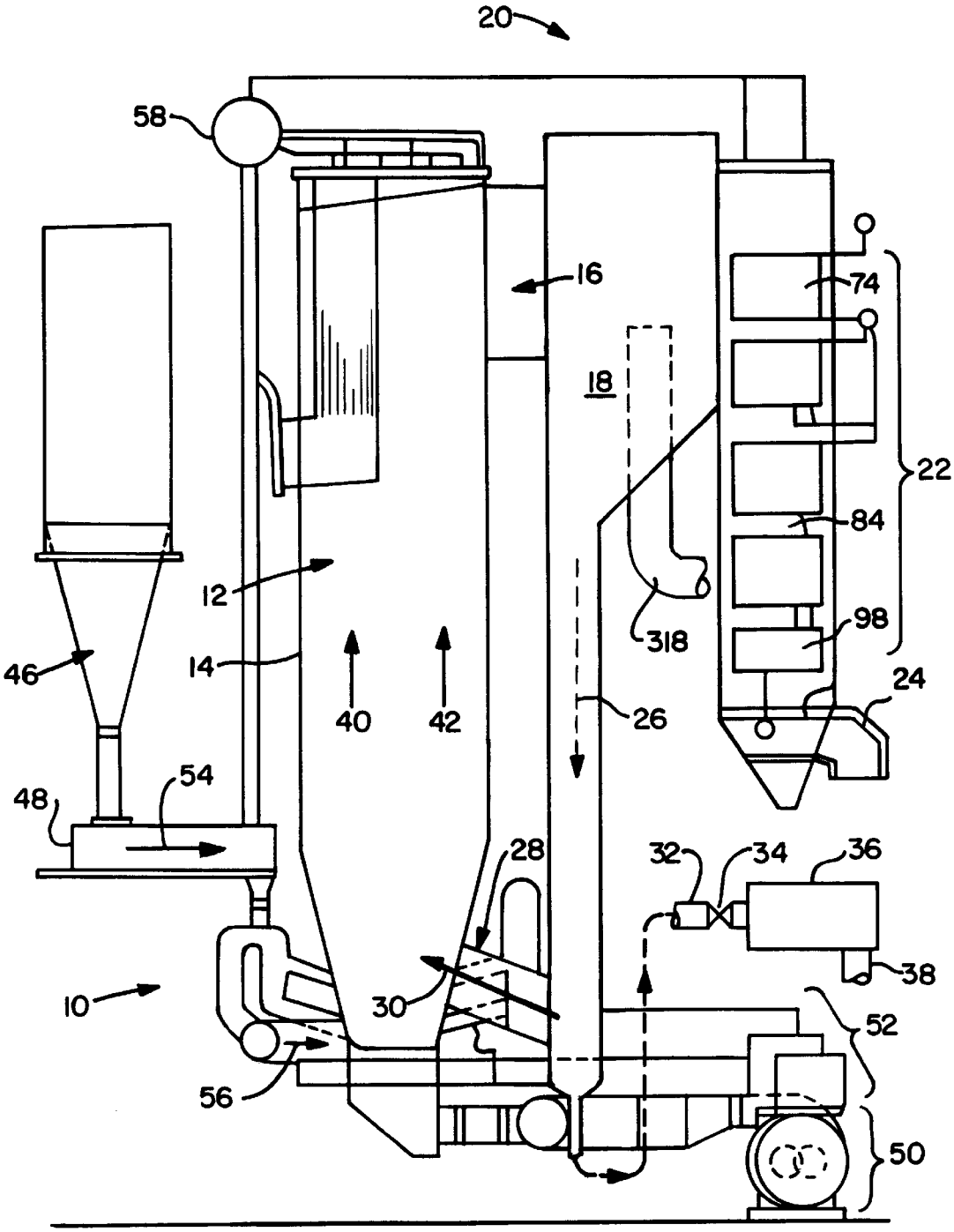
FIG. 1 is a schematic representation in the nature of a side elevational view of a circulating fluidized bed steam generator (CFB) including a combined hot solids-gas separator of the present invention, a furnace volume, a backpass section, a combined hot solids-gas separator section and a fluidized bed heat exchanger (FBHE) section.
Figure 2:
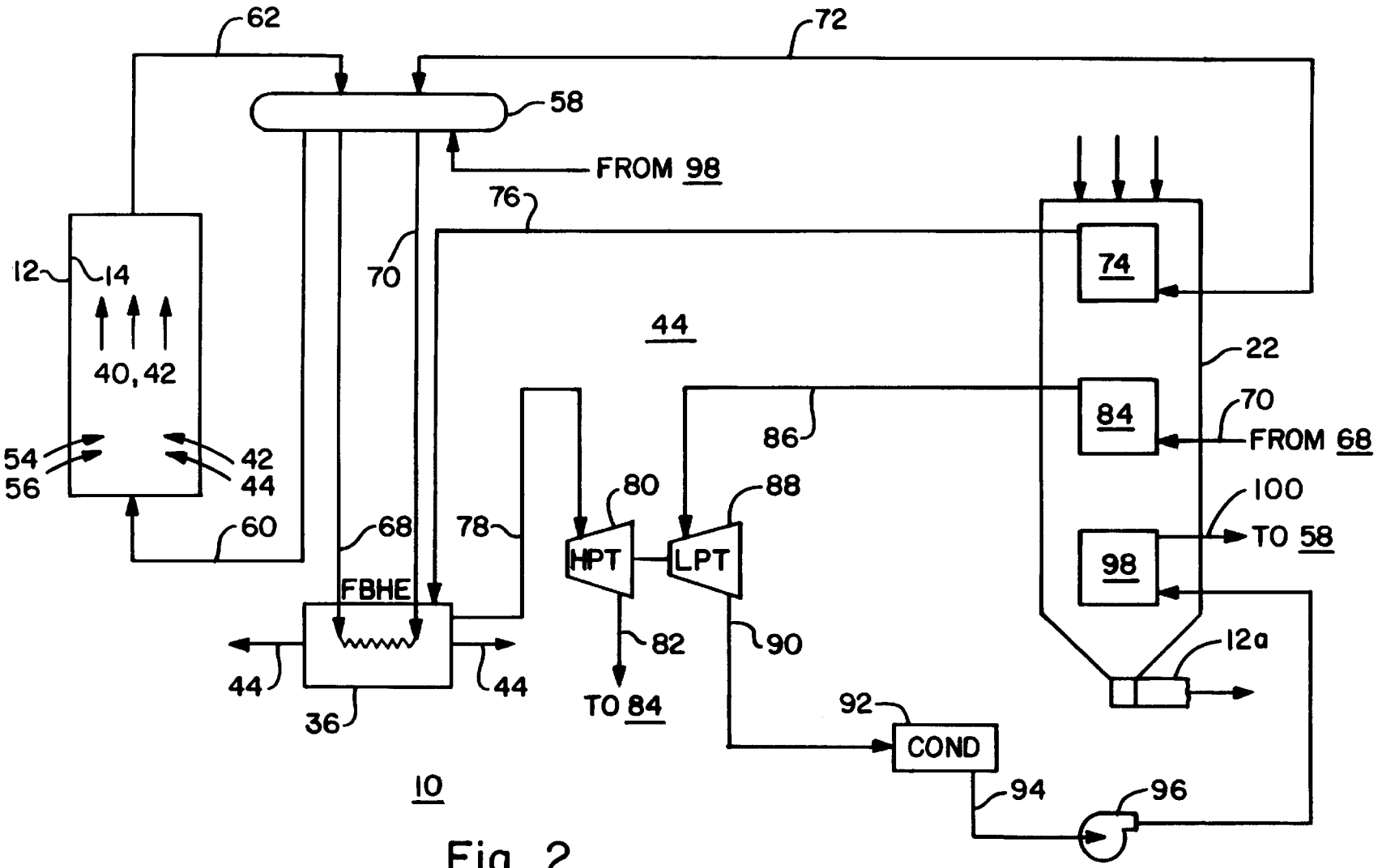
FIG. 2 is a simplified schematic representation of the fluid circuitry of the thermodynamic steam cycle employed with the circulating fluidized bed steam generator illustrated in FIG. 1.

As seen in FIGS. 1 and 2 of the drawings, a circulating fluidized bed steam generator (CFB), generally designated by the reference numeral 10, is illustrated. It is to be understood that the configuration of the circulating fluidized bed steam generator 10, including the presence or absence, the placement, and the interconnection of its assorted elements, as illustrated and described herein, is to be understood as merely exemplary of a circulating fluidized bed system in which a combined hot solids-gas separator in accordance of the present invention may be employed. For this reason, it is noted that the following discussion of the circulating fluidized bed steam generator 10 discloses merely one possible operational arrangement and it is contemplated that, as desired or as dictated by circumstances, the configuration of the circulating fluidized bed steam generator 10, including the presence or absence, the placement, and the interconnection of its assorted elements, may be changed while nonetheless representing an embodiment of the circulating fluidized bed system of the present invention.

As illustrated in FIG. 1, the circulating fluidized bed steam generator 10 includes a furnace volume, denoted therein by the reference numeral 12, the latter being defined by waterwall tubes, denoted therein by the reference numeral 14; a first section of ductwork, denoted therein by the reference numeral 16; and a combined hot solids-gas separator, denoted therein by the reference numeral 18 which is operable to separate one from another two resultants of the combustion process performed in the circulating fluidized bed steam generator 10—namely, the two resultants of hot solids and hot gases. The combined hot solids-gas separator 18 is advantageously configured in accordance with the present invention to efficiently perform such separation of hot solids from hot gases while offering improved durability and operation. The circulating fluidized bed steam generator 10 also includes an intermediate section of backpass ductwork, denoted therein by the reference numeral 20; and a backpass volume, denoted therein by the reference numeral 22, from which further ductwork, denoted therein by the reference numeral 24, extends.

The furnace volume 12 is water cooled via water transported through the waterwall tubes 14 whereas the combined hot solids-gas separator 18 and the backpass volume are steam cooled via tubes integrated into their wall structures.

The lower segment of the combined hot solids-gas separator 18 is connected in fluid flow relation with the lower segment of the furnace volume 12 through a fluid flow system consisting, in accordance with the illustration thereof in FIG. 1 of an initial collection path, denoted therein by the reference numeral 26; a direct return measured feed device, denoted therein by the reference numeral 28; a direct return path, denoted therein by the reference numeral 30; a fluidized bed heat exchanger (FBHE) inlet, denoted therein by the reference numeral 32; an ash control valve, denoted therein by the reference numeral 34; a fluidized bed heat exchanger (FBHE), denoted therein by the reference numeral 36; and a fluidized bed heat exchanger (FBHE) outlet, denoted therein by the reference numeral 38. For purposes of the discussion that follows hereinafter, the ductwork 16, the combined hot solids-gas separator 18 and the fluid flow system 26, 28, 30, 32, 34, 36, 38 will be referred to as a hot solids circulation path, denoted by the reference numerals 40, 42, 44. Further, it is to be understood that the fluid flow system 26, 28, 30, 32, 34, 36, 38 is typical of the fluid flow system, which is cooperatively associated with the combined hot solids-gas separator 18. It can be seen from a reference to FIG. 1 of the drawing that the furnace volume 12 is in communication with a source, denoted therein by the reference numeral 46, of fuel and sorbent through a supply line, denoted therein by the reference numeral 48, as well as with a source, denoted therein by the reference numeral 50, of air through a supply line, denoted therein by the reference numeral 52.

With regard to FIG. 1 of the drawing, it will be understood from reference thereto that in the lower segment of the furnace volume 12 a mixture of fuel and sorbent, denoted therein by the reference numeral 54, is mixed for purposes of the combustion thereof with air, denoted therein by the reference numeral 56. Preferably, fluidizing air is fed through a floor grate on which the fluidized bed of the furnace volume 12 is disposed and secondary air is fed at two levels above the floor grate. Moreover, it is preferred to configure the feed and sorbent supply line 48 to include air-assisted fuel and sorbent feed nozzles to thereby advantageously minimize waterwall penetration opening size and to minimize fuel chute plugging potential.

In known fashion, from this combustion, hot combustion gases, denoted therein by the reference numeral 40, are produced and hot solids, denoted therein by the reference numeral 42, are entrained in the hot combustion gases 40. These hot combustion gases 40 with the hot solids 42 entrained therewith rise within the furnace volume 12 whereupon at the top of the furnace volume 12 the hot combustion gases 40 with the hot solids 42 entrained therewith are made to flow through the duct 16 to the combined hot solids-gas separator 18.

Within the combined hot solids-gas separator 18, the hot solids 42 that are made to flow thereto, which are above a predetermined size, are separated from the hot combustion gases 40 in which they are entrained. The separated hot solids 42 which contain unburned fuel, flyash and sorbent flow through the combined hot solids-gas separator 18. From the combined hot solids-gas separator 18, the hot solids 42 are discharged under the influence of gravity into the initial collection path 26, from whence a portion of the hot solids 42 flow through the initial collection path 26 to and through the direct return measured feed device 28. Thereafter, from the direct return measured feed device 28, this portion of the hot solids 42 is reintroduced by means of a corresponding direct return path 30 into the lower segment of the furnace volume 12 whereupon this portion of the hot solids 42 are once again subjected to the combustion process that takes place in the circulating fluidized bed steam generator (CFB) 10. The remainder of the hot solids 42 which are above a predetermined size, denoted as heat exchanger hot solids 44, are diverted from the combined hot solids-gas separator 18 to the fluidized bed heat exchanger (FBHE) 36 by way of the heat exchanger inlet 32 and thence to the lower segment of the furnace volume 12 via a corresponding heat exchanger outlet 38.

Continuing, on the other hand, the hot combustion gases 40 leaving the combined hot solids-gas separator 18, hereinafter referred to as flue gases, are directed from the combined hot solids-gas separator 18 via the intermediate backpass ductwork 20 to the backpass volume 22, where additional heat transfer duty is performed therewith as will be described more fully hereinafter. From the backpass volume 22, the flue gases 40 exit through the ductwork 24 to a particulate removal system (not shown in the interest of maintaining clarity of illustration in the drawings) whereupon the flue gases 40 are discharged to the atmosphere through a stack (not shown in the interest of maintaining clarity of illustration in the drawings).

For purposes of better understanding how the combustion process occurring within the furnace volume 12 is integrated with the hot solids circulation path 40, 42, and the flow path of the flue gases, and with the thermodynamic steam cycle of the circulating fluidized bed steam generator (CFB) 10, reference will now be had to FIG. 2 of the drawings. As will be understood with reference to FIG. 2, the thermodynamic steam cycle includes a first evaporative steam loop 58, 60, 14, 62, 58 which is designed to act in parallel with a second evaporative steam loop 58, 68, 70, 58. Finally, it will be understood with reference to FIG. 2 that the thermodynamic steam cycle also includes a superheat steam, a reheat steam segment, and an economizer segment.

The first evaporative steam loop 58, 60, 14, 62, 58 becomes operative as a function of the combustion process, which takes place within the furnace volume 12. As has been noted herein previously, as the hot combustion gases 40 with the hot solids 42 entrained therewith rise within the furnace volume 12 heat is transferred therefrom to the waterwall tubes 14, which serve to define the furnace volume 12. As a consequence thereof, the saturated water, denoted in FIG. 2 by the reference numeral 60, which enters the waterwall tubes 14 from the steam drum, denoted in FIG. 2 by the reference numeral 58, is evaporatively changed to a mixture, denoted in FIG. 2 by the reference numeral 62, of saturated water and saturated steam. This mixture 62 then flows to the steam drum 58 for separation wherein saturated water 60 is once again made to flow to the waterwall tubes 14 while the saturated steam, denoted in FIG. 2 by the reference numeral 72, is made to flow to the superheat surface, denoted in FIG. 2 by the reference numeral 74, which has been suitably provided in the backpass volume 22 and to which further reference will be had hereinafter.

The second evaporative steam loop 58, 68, 70, 58 becomes operative as a result of the heat transfer process, which takes place within the fluidized bed heat exchanger (FBHE) 36. To this end, saturated water, denoted in FIG. 2 by the reference numeral 68, which originates from the steam drum 58, enters the fluidized bed heat exchanger (FBHE) 36. In the course of the passage thereof through the fluidized bed heat exchanger (FBHE) 36, the saturated water 68 is converted to a mixture, denoted in FIG. 2 by the reference numeral 70, of saturated steam and saturated water as a result of the heat transfer, which occurs as the hot solids, denoted in FIG. 2 by the reference numeral 42, flow through the fluidized bed heat exchanger (FBHE) 36. The mixture 70 of saturated steam and saturated water then flows to the steam drum 58 for separation wherein the saturated water 68 is once again made to flow to the fluidized bed heat exchanger (FBHE) 36, while the saturated steam, denoted in FIG. 2 by the reference numeral 72 is made to flow to the superheater, denoted in FIG. 2 by the reference numeral 74, to which further reference will be had hereinafter.

Continuing, within the superheater 74, a transfer of heat takes place between the relatively cool saturated steam 72 and the relatively hot flue gases to which reference has been made hereinbefore. The steam, denoted in FIG. 2 by the reference numeral 76, exiting from the superheater 74 is now in a superheated state. From the superheater 74, the steam 76 is made to flow to the fluidized bed heat exchanger (FBHE) 36, wherein the steam 76 is further superheated by a transfer of heat thereto from the relatively hot solids 42 that circulate through the fluidized bed heat exchanger (FBHE) 36. Upon exiting from the fluidized bed heat exchanger (FBHE) 36, the steam, denoted in FIG. 2 by the reference numeral 78, is now in a highly superheated state and is made to flow to the high pressure turbine (HPT), denoted in FIG. 2 by the reference numeral 80.

After expansion within the high pressure turbine (HPT) 80, the still superheated steam, denoted in FIG. 2 by the reference numeral 82, is made to flow to the reheater, denoted in FIG. 2 by the reference numeral 84. Within the reheater 84 there takes place a transfer of heat to the relatively cool superheated steam 82 from the still relatively hot flue gases, to which reference has been had herein previously. The steam, denoted in FIG. 2 by the reference numeral 86, exiting from the reheater 84 is still in a superheated state. From the reheater 84, the steam 86 is made to flow to the low pressure turbine (LPT), which is denoted in FIG. 2 by the reference numeral 88.

After further expansion within the low pressure turbine (LPT) 88, the now saturated steam, denoted in FIG. 2 by the reference numeral 90, flows to a condenser, denoted in FIG. 2 by the reference numeral 92, wherein the saturated steam 90 is converted to water, denoted in FIG. 2 by the reference numeral 94. The water 94 is then made to flow by means of a pump, denoted in FIG. 2 by the reference numeral 96, to the economizer, denoted in FIG. 2 by the reference numeral 98. Within the economizer 98, a transfer of heat takes place from the still relatively hot flue gases, to which reference has been made herein previously, to the relatively cool water, denoted in FIG. 2 by the reference numeral 100. Upon exiting from the economizer 98, the water is in a saturated state and is made to flow to the steam drum 58. The preceding completes the description herein of the steam cycle of the circulating fluidized bed steam generator (CFB) 10.

The steam produced within the aforedescribed steam cycle of the circulating fluidized bed steam generator (CFB) 10 is operative to provide in known fashion the motive power, which is required to drive the high pressure turbine (HPT) 80 as well as the low pressure turbine (LPT) 88. The high pressure turbine (HPT) 80 and the low pressure turbine (LPT) 88 in turn are cooperatively associated with a generator (not shown in the interest of maintaining clarity of illustration in the drawing), which is operative to produce electricity in a conventional manner.

Figure 3A:
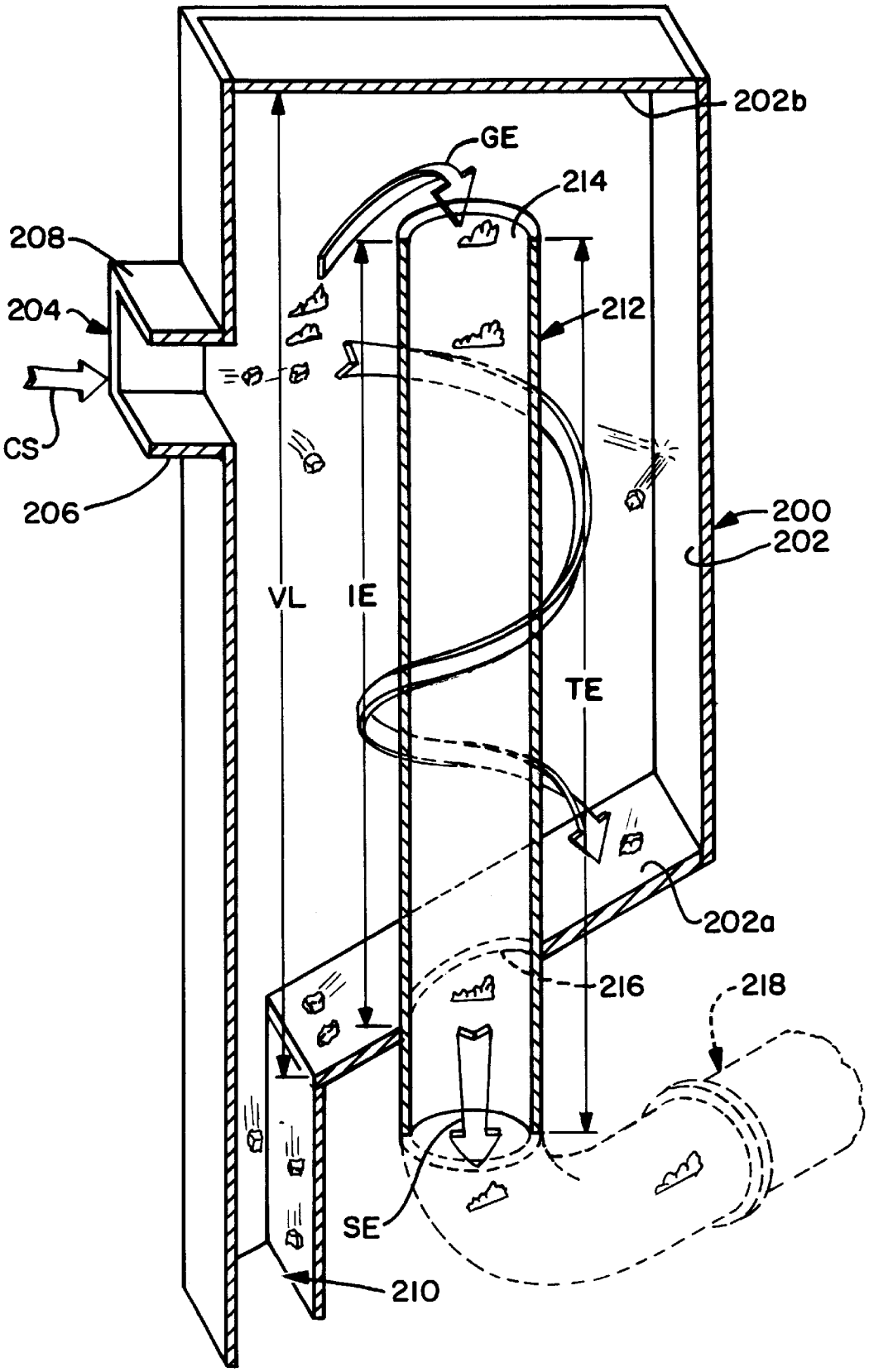
FIG. 3A is a perspective view, in vertical section and taken along line IIIA—IIIA of FIG. 4A, of one of the pair of cyclone assemblies of one embodiment of the combined hot solids-gas separator of the fossil fuel-fired steam generation system shown in FIG. 1.
Figure 4A:
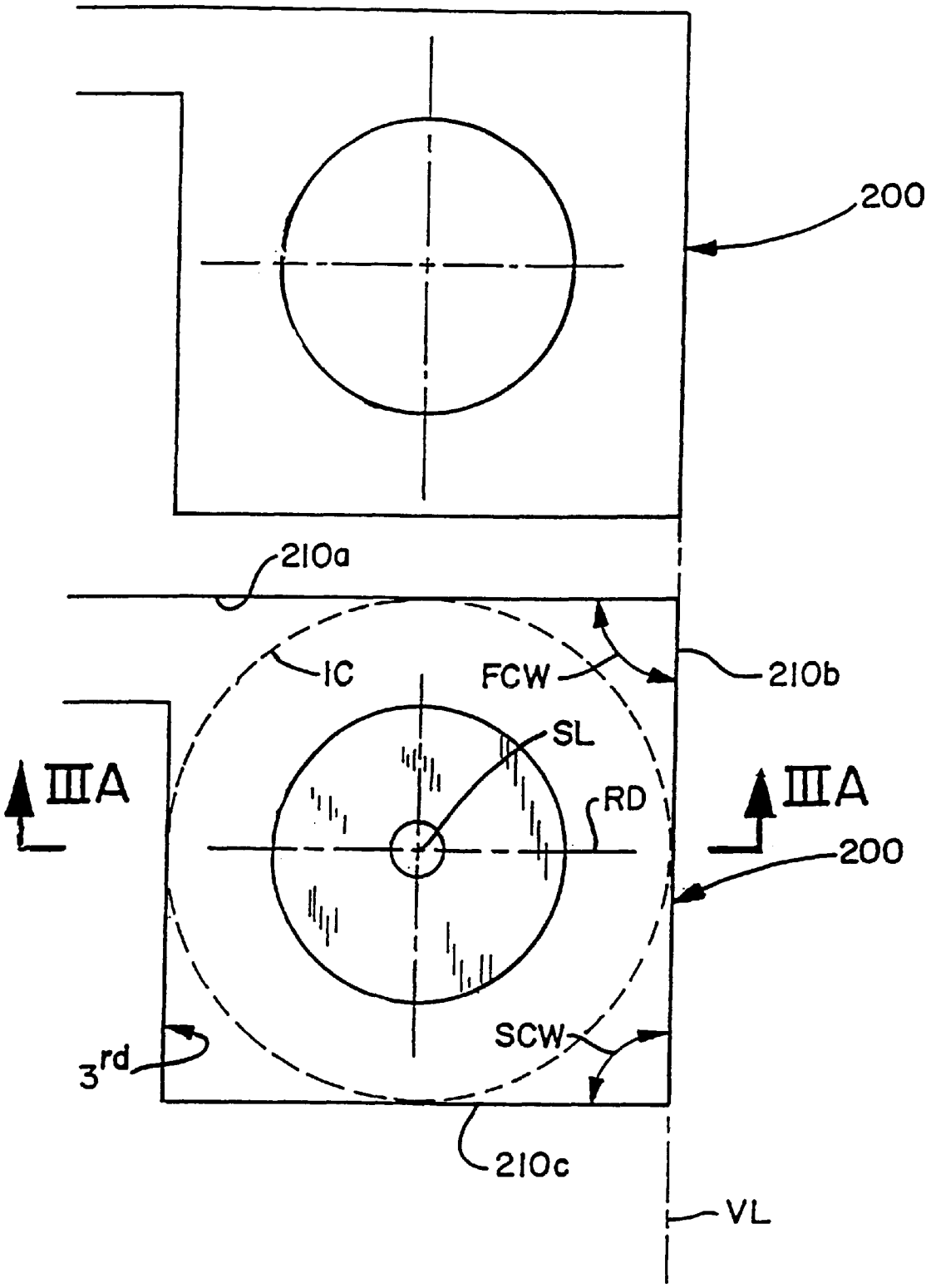
FIG. 4A is a top plan view of the pair of cyclone assemblies of the one embodiment of the combined hot solids-gas separator.

With further reference now to the feature of the combined hot solids-gas separator 18 of the circulating fluidized bed steam generator (CFB) 10, the combined hot solids-gas separator 18 thereof may comprise multiple independent assemblies for separating the hot solids 42 from the gas 40 of the gas-solids stream 40, 42. As seen in FIGS. 3A and 4A, in one embodiment thereof, the combined hot solids-gas separator 18 is configured as a pair of cyclone assemblies 200, each independently operable for separating the hot solids 42 from gas of a gas-solids stream 40, 42. For ease of discussion, only the components and operation of one of the cyclone assemblies 200 will now be described, it being understood that the other cyclone assembly 200 is comprised of identical components and operates in an identical manner.

As seen in particular in FIGS. 3A and 4A, the cyclone assembly 200 includes an outer housing having a plurality of wall portions 202 forming a separation chamber and an inlet 204 for passage of a combined gas-solids stream CS into the separation chamber. The inlet 204 has a lengthwise (vertical) extent defined between a lower floor extent 206 and an upper ceiling extent 208. The lower floor extent 206 forms a threshold over which the combined gas-solids stream CS flows in entering the separation chamber.

The separation chamber is operable to separate the combined gas-solids stream CS into a predominantly gas exit stream GE and a predominantly solids exit stream SE in a manner by which separated out solids to be discharged from the separation chamber via the predominantly solids exit stream SE are collected within the separation chamber at a location lower than the inlet 204. While details of the separation operation will be described later, it is now noted that the location at which the separated out solids are collected is comprised of a wall portion 202A of the outer housing and a separated solids discharge for the discharge therethrough of the predominantly solids exit stream SE having the collected separated out solids therein in the form of a discharge chute 210. The wall portion 202A is configured as a downwardly sloping planar member acting to urge the separated out solids to slide downwardly into the discharge chute 210.

The cyclone assembly 200 also includes a gas outlet duct 212 for outward flow of the predominantly gas exit stream GE out of the separation chamber. The gas outlet duct 212 has an entrance 214 within the separation chamber for the passage of the predominantly gas exit stream GE thereinto. The gas outlet duct 212 is operable to exert a vortex effect capable of drawing gas into the gas outlet duct.

The gas outlet duct 212 has an extent from its entrance 214 to at least an exterior interface 216 between the gas outlet duct 212 and the separation chamber beyond which the gas outlet duct 212 is communicated with an area exterior of the separation chamber. In the one embodiment shown in FIG. 3A, it can be seen that the total lengthwise (vertical) extent of the gas outlet duct 212 extends from the entrance 214 of the gas outlet duct 212 to its connection with an interconnecting duct 218 (shown in broken lines) which communicates the gas outlet duct 212 with a stack (not shown). The extent of the gas outlet duct 212 within the separation chamber from the gas outlet duct entrance 214 to the exterior interface 216 (as measured at the lowermost intersection of the gas outlet duct and the exterior interface 216) is designated as IE in FIG. 3A and the total extent of the gas outlet duct 212 from the gas outlet duct entrance 214 to its connection with the interconnecting duct 218 exteriorly of the cyclone separator assembly 200 is designated as TE.

Preferably, the interior extent IE of the gas outlet duct 212 is at least fifty percent (50%) of the lengthwise (vertical) extent VL of the separation chamber of the cyclone separator assembly 200 (the lengthwise (vertical) extent VL of the separation chamber is measured between the wall portion 202B and the intersection of the wall portion 202A and the discharge chute 210). Preferably, the interior extent IE of the gas outlet duct 212 is between about fifty percent (50%) to about ninety percent (90%) of the lengthwise (vertical) extent VL of the separation chamber of the cyclone separator assembly 200.

In accordance with the present invention, the cyclone assembly 200 is configured with the selected placement of certain components thereof relative to other certain components. Specifically, the threshold of the separation chamber inlet 204 (formed by the lower floor 206) is relatively higher than the exterior interface 216 of the gas outlet duct 212 and the separation chamber. Moreover, the threshold of the separation chamber inlet 204 is relatively lower than the entrance 214 of the gas outlet duct 212. Additionally, in the cyclone assembly 200 shown in FIGS. 3A and 4A, the upper ceiling 208 of the separation chamber inlet 204 is disposed in opposition to, and spaced above, the lower floor 206 forming the threshold of the inlet 204 and the entrance 214 of the gas outlet duct 212 is relatively higher than the upper ceiling 208 of the separation chamber inlet 204—in particular, the entrance 214 of the gas outlet duct 212 is located at a height differential above the threshold of the separation chamber inlet 204 which is at least one half of the height differential between a top wall portion 202B disposed above the entrance of the gas outlet duct and the lower floor.

Figure 3B:
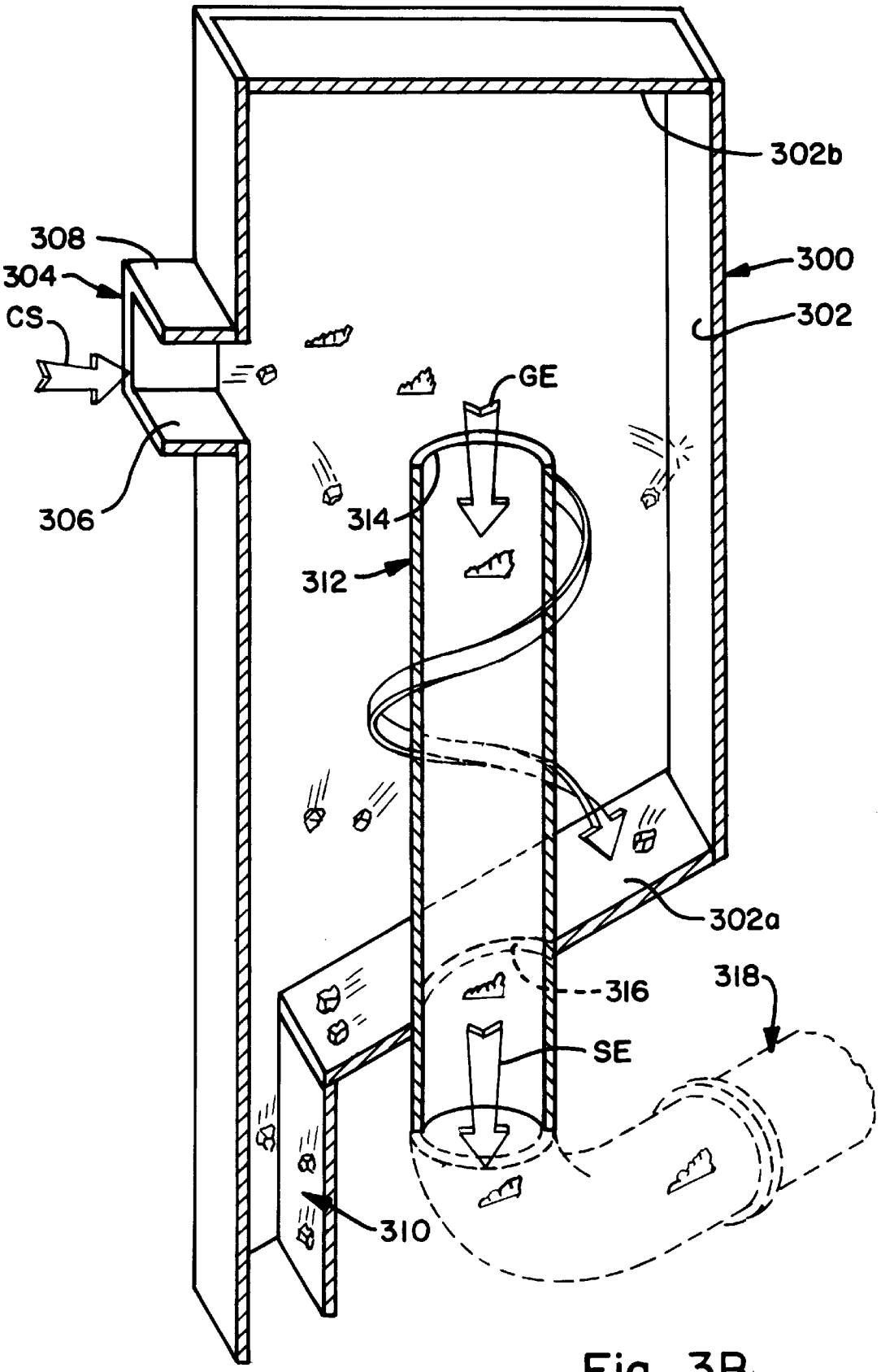
FIG. 3B is a perspective view, in vertical section and taken along line IIIB—IIIB of FIG. 4B, of one of the pair of cyclone assemblies of another embodiment of the combined hot solids-gas separator.
Figure 4B:
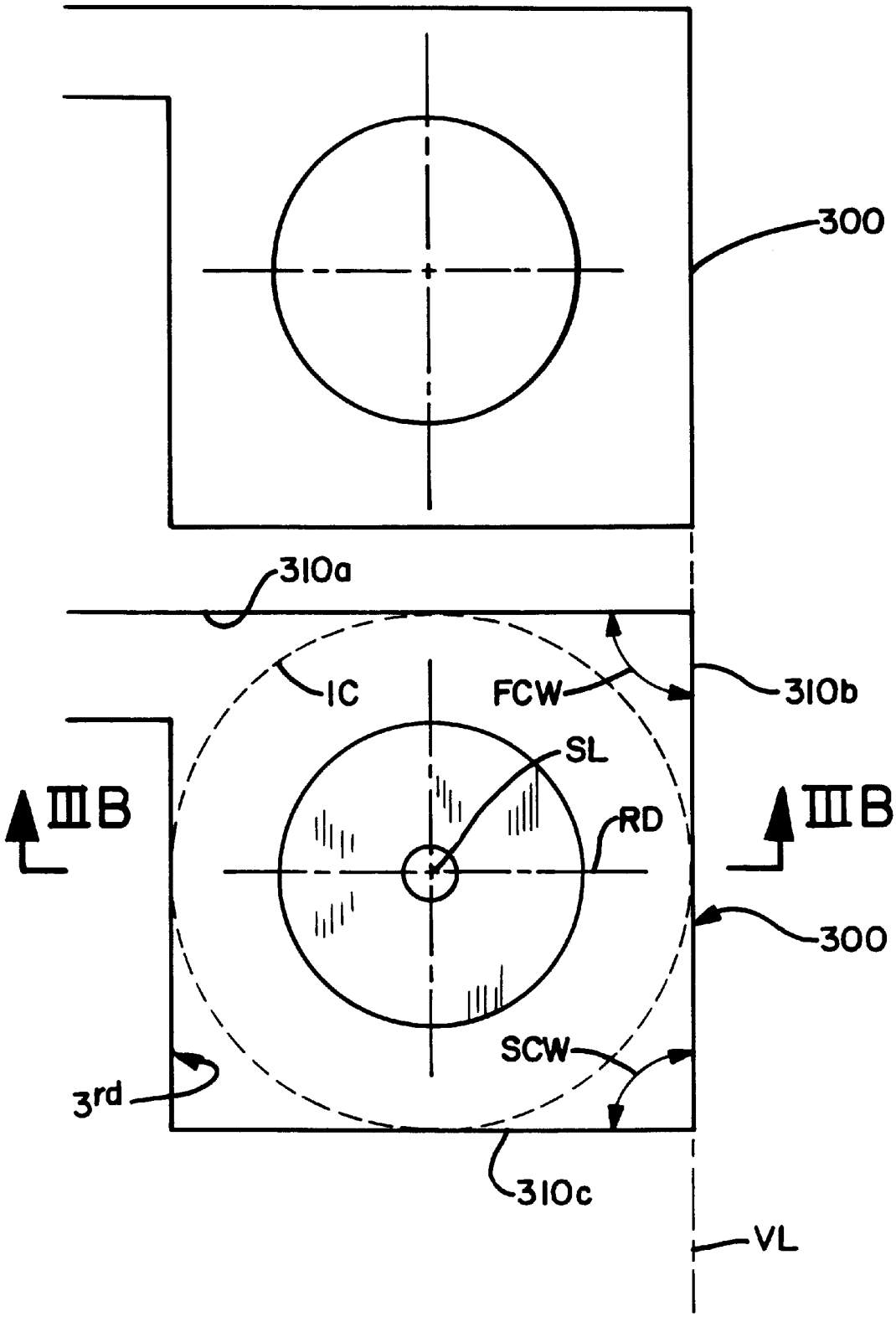
FIG. 4B is a top plan view of the pair of cyclone assemblies of the another embodiment of the combined hot solids-gas separator.

As seen in FIGS. 3B and 4B, in another embodiment of the combined hot solids-gas separator 18, the separator 18 is configured as a pair of cyclone assemblies 300, each independently operable for separating the hot solids 42 from gas of a gas-solids stream 40, 42. For ease of discussion, only the components and operation of one of the cyclone assemblies 300 will now be described, it being understood that the other cyclone assembly 300 is comprised of identical components and operates in an identical manner.

The cyclone assembly 300 includes an outer housing comprised of a plurality of wall portions 302 forming a separation chamber and an inlet 304 for passage of a combined gas-solids stream CS into the separation chamber. The inlet 304 has a lengthwise (vertical) extent defined between a lower floor extent 306 and an upper ceiling extent 308. The lower floor extent 306 forms a threshold over which the combined gas-solids stream CS flows in entering the separation chamber.

The separation chamber is operable to separate the combined gas-solids stream CS into a predominantly gas exit stream GE and a predominantly solids exit stream SE in a manner by which separated out solids to be discharged from the separation chamber via the predominantly solids exit stream SE are collected within the separation chamber at a location lower than the inlet 304. While details of the separation operation will be described later, it is now noted that the location at which the separated out solids are collected is comprised of a wall portion 302A of the outer housing and a separated solids discharge for the discharge therethrough of the predominantly solids exit stream SE having the collected separated out solids therein in the form of a discharge chute 310. The wall portion 302A is configured as a downwardly sloping planar member acting to urge the separated out solids to slide downwardly into the discharge chute 310.

The cyclone separator assembly 300 also includes a gas outlet duct 312 for outward flow of the predominantly gas exit stream GE out of the separation chamber. The gas outlet duct 312 has an entrance 314 within the separation chamber for the passage of the predominantly gas exit stream GE thereinto. The gas outlet duct 312 has an extent from its entrance 314 to at least an exterior interface 316 between the gas outlet duct 312 and the separation chamber beyond which the gas outlet duct 312 is communicated with an area exterior of the separation chamber. As seen in FIG. 3B, this lengthwise (vertical) extent extends from the entrance 314 of the gas outlet duct 312 to its connection with an interconnecting duct 318 (shown in broken lines) which communicates the gas outlet duct 312 with a stack (not shown). The gas outlet duct 312 is operable to exert a vortex effect capable of drawing gas into the gas outlet duct.

In accordance with the present invention, each of the cyclone assemblies 300 of the another embodiment of the separator 18 shown in FIGS. 3B and 4B is configured with the selected placement of certain components thereof relative to other certain components. Specifically, the threshold of the separation chamber inlet 304 (formed by the lower floor 306) is relatively higher than the exterior interface 316 of the gas outlet duct 312 and the separation chamber. Moreover, the threshold of the separation chamber inlet 304 is relatively lower than the entrance 314 of the gas outlet duct 312. As seen in FIGS. 3B and 4B, the upper ceiling 308 of the separation chamber inlet 304 is disposed in opposition to, and spaced above, the lower floor 306 forming the threshold of the inlet 304 and the entrance 314 of the gas outlet duct 312 is located no higher than the upper ceiling 308—in particular, the entrance 314 of the gas outlet duct 312 is at generally the same vertical level as the upper ceiling 308 of the separation chamber inlet 304.

In the two embodiments of the separator 18 shown in FIGS. 3A and 4A and FIGS. 3B and 4B, respectively, each of the cyclone assemblies has a gas outlet duct whose extent is substantially without openings below the entrance to the gas outlet duct so as to thereby effectively preclude the entrance of gas into the gas outlet duct below the entrance.

Figure 5:
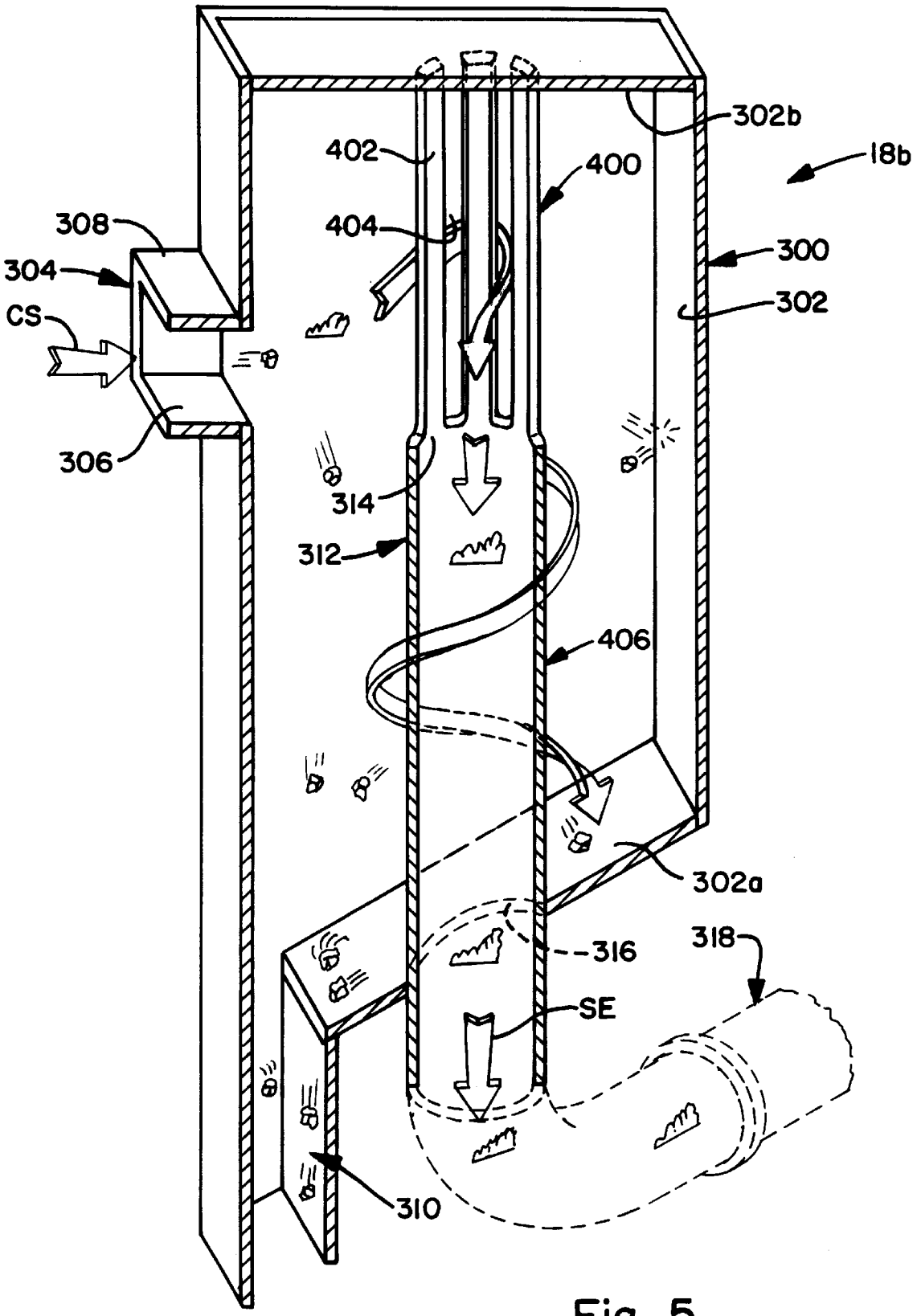
FIG. 5 is a perspective view, in vertical section, of one variation of the cyclone assembly shown in FIGS. 3B and 4B.

In one variation of the cyclone assembly of the separator 18, the entrance of the gas outlet duct is formed by a selective barrier portion extending from the gas outlet duct to one of the wall portions of the separation chamber. For example, as seen in FIG. 5, the cyclone assembly 300 of the embodiment shown in FIGS. 3B and 4B may be provided with a selective barrier portion 400 which extends from the gas outlet duct 312 to the wall portion 302B. The selective barrier portion 400 is comprised of a plurality of elongate slats 402 individually spaced apart from one another around an annular periphery such that each adjacent pair of slats form an elongate vertically extending opening 404 therebetween. Each slat 402 is fixedly mounted at its top end to the roof wall portion 302B of the cyclone assembly 300 and each slat extends downwardly to a bottom end which joins with the top of the gas outlet duct 312. The gas outlet duct 312 extends in a solid annular shape with no inlet openings for the entry therein of separated hot gases except for the open top end of the gas outlet duct through which flow the hot gases 42 which have entered into the selective barrier portion 400 through its elongate openings 404.

In operation, hot gases 42 which have entered the cyclone assembly 300 flow around and adjacent to the annular periphery of the selective barrier portion 400 and ultimately enter thereinto via the openings 404. On the other hand, hot solids 40 above a minimum size or density are disentrained from the hot gases 42 due to a number of causes such as impact with the slats 402 or deceleration of the solids relative to the hot gases flowing around the selective barrier portion 400. Thus, these hot solids 40 do not tend to enter the selective barrier portion 400 and, instead, ultimately move downwardly within the separation chamber to be collected and discharged via the discharge chute 310.

Figure 6:
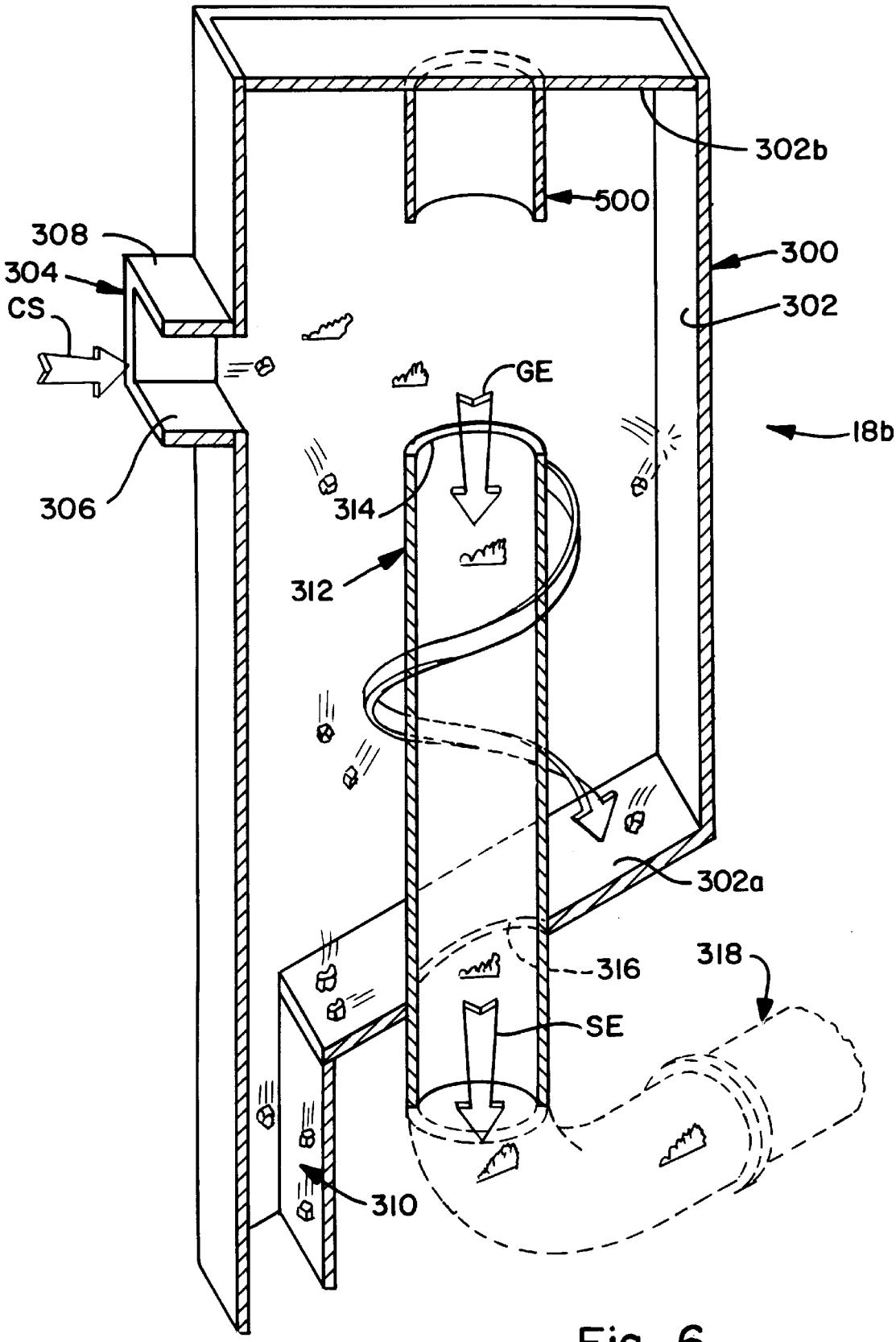
FIG. 6 is a perspective view, in vertical section, of another variation of the cyclone assembly shown in FIGS. 3B and 4B.

In another variation of the cyclone assembly of the separator 18, one of the wall portions forming the separation chamber of the cyclone assembly is disposed at a spacing from and above the entrance of the gas outlet duct and a vortex enhancement element is mounted to the one wall portion to extend toward the gas outlet duct. For example, as seen in FIG. 6, the cyclone assembly 300 has been provided with a vortex enhancement element 500 mounted to the wall portion 302B and having an annular peripheral extent substantially aligned and compatibly dimensioned with the peripheral extent of the gas outlet duct 312. The vortex enhancement element 500 cooperates with the gas outlet duct 312 to promote the formation of a vortex action within the gas outlet duct. Depending upon the characteristics of the flow of the hot solids 40 and the hot gases 42 within the separation chamber, the vortex enhancement element 500 may promote the formation of a vortex or helical flow in cooperation with the vortex promoting effect of the gas outlet duct 312 itself.

Reference is now had to FIG. 7 for a discussion of the another embodiment of the circulating fluidized bed steam generator 510. The circulating fluidized bed steam generator 510 includes a furnace volume, denoted therein by the reference numeral 512, the latter being defined by waterwall tubes, denoted therein by the reference numeral 514; a first section of ductwork, denoted therein by the reference numeral 516; a combined hot solids-gas separator, denoted therein by the reference numeral 518; an intermediate section of backpass ductwork, denoted therein by the reference numeral 520; and a backpass volume, denoted therein by the reference numeral 522, from which further ductwork, denoted therein by the reference numeral 524, extends. The lower segment of the combined hot solids-gas separator 518 is connected in fluid flow relation with the lower segment of the furnace volume 512 through a fluid flow system consisting, in accordance with the illustration thereof in FIG. 7 of an initial collection path, denoted therein by the reference numeral 526.

The combined hot solids-gas separator 518 is preferably configured as a cyclone assembly identical to the cyclone assembly 300 illustrated in FIGS. 3B and 5 except that the outer housing of the combined hot solids-gas separator 518 illustrated in FIG. 7 is comprised of a wall portion of a cylindrical shape instead of the parallelepiped shape of the wall portions 302 of the cyclone assembly 300.

The separation chamber of the hot solids-gas separator 518 illustrated in FIG. 7 is operable to separate the combined gas-solids stream which flows into the cyclone assembly into a predominantly gas exit stream and a predominantly solids exit stream in a manner by which separated out solids to be discharged from the separation chamber via the predominantly solids exit stream are collected within the separation chamber at a location lower than the inlet of the hot solids-gas separator 518. The cylindrical wall portion of the hot solids-gas separator 518 merges into a downwardly sloping planar member 528 acting to urge the separated out solids to slide downwardly into the discharge chute 526.

The hot solids-gas separator 518 also includes a gas outlet duct 530 for outward flow of the predominantly gas exit stream out of the separation chamber. The gas outlet duct 530 has an entrance within the separation chamber for the passage of the predominantly gas exit stream thereinto. The gas outlet duct 530 has an extent from its entrance to at least an exterior interface 532 between the gas outlet duct and the separation chamber beyond which the gas outlet duct 530 is communicated with the outside or exterior of the separation chamber.

The hot solids-gas separator 518 is disposed on one lateral side of the furnace 512, as viewed relative to a lateral axis AT, and has a chamber side face 534 in facing relation to the furnace 512. The hot solids-gas separator 518 has a predetermined lateral extent, hereinafter designated as the width W-SEP, which is effectively equal to the diameter of its cylindrical wall portion and the furnace 512 has a predetermined lateral extent measured relative to the lateral axis AT. The top surface of the hot solids-gas separator 518 is at a height H-SEP, as measured in a longitudinal direction relative to a longitudinal axis LO perpendicular to the lateral axis AT. The height of the exterior interface 532 of the gas outlet duct 530, as measured to the centerpoint of the circle formed by the intersection of the cylindrically shaped backpass ductwork 520 and the planar surface 528 of the hot solids-gas separator 518, is less than the height H-SEP of the top surface of the hot solids-gas separator 518 and is generally designated as height H-EXT.

The backpass volume 522 operates as a heat exchanger means for receiving cleaned gas from the hot solids-gas separator 518. The backpass volume 522 has a principal heat exchange region, generally designated as 536, defined by that portion of the backpass volume in which more than half [i.e., more than fifty percent (50%)] of its heat exchange duty is performed. In the embodiment of the circulating fluidized bed steam generator 510 shown in FIG. 7, this principal heat exchange region 536 is comprised of a plurality of parallelepiped shaped blocks of heat exchange surfaces of the backpass volume 522 which collectively define an overall rectangular block shape having a predetermined lateral extent, designated as width W-BV, as measured relative to the lateral axis AT and a center of gravity CG located at the center of the rectangular block. In other configurations of the backpass volume which have an overall shape different than that of a rectangular block, the location of the center of gravity CG will necessarily be determined by the particular arrangement and individual masses of the heat exchange surfaces defining the overall shape of the backpass volume.

The center of gravity CG is at a lateral spacing SPA-CG from the chamber side face 534 of the hot solids-gas separator 518 in which the lateral spacing SPA-CG is no greater than one hundred and twenty five percent (125%) of the width W-SEP of the hot solids-gas separator 518. This lateral spacing SPA-CG is most preferably between about fifty percent (50%) to about one hundred percent (100%) of the width W-SEP of the hot solids-gas separator 518. For example, the lateral spacing SPA-CG of the center of gravity CG of the principal heat exchange region 536 shown in FIG. 7 is between fifty percent (50%) and seventy-five percent (75%) of the width W-SEP of the hot solids-gas separator 518.

The center of gravity CG of the principal heat exchange region 536 has a height H-CG which is no higher than the height H-EXT of the exterior interface 532 of the gas outlet duct 530 of the hot solids-gas separator 518. The height H-CG of the center of gravity CG of the principal heat exchange region 536 is preferably between about twenty-five percent (25%) to about seventy five percent (75%) of the height H-EXT of the exterior interface 532 of the gas outlet duct 530. For example, the height H-CG of the center of gravity CG of the principal heat exchange region 536 of the embodiment of the circulating fluidized bed steam generator 510 shown in FIG. 7 is approximately fifty percent (50%) of the height H-EXT of the exterior interface 532 of the gas outlet duct 530. Also, in this embodiment, the height H-PR of the top surface of the principal heat exchange region 536 of the backpass volume 522 is greater than the height H-CG of the center of gravity CG and less than the height H-EXT of the exterior interface 532 of the gas outlet duct 530 although, in a backpass volume having a different overall arrangement of heat exchange surfaces, the height H-PR of the top surface of the principal heat exchange region of the respective backpass volume may possibly be greater than the height H-EXT of the exterior interface of the gas outlet duct of the hot solids-gas separator.

The circulating fluidized bed steam generator 510 also includes a support structure 538 for supporting the steam generator in its erected condition. The support structure 538 includes a load bearing assembly 540 for supporting the hot solids-gas separator 518 and this load bearing assembly is configured, in the embodiment of the circulating fluidized bed steam generator 510 shown in FIG. 7, as a load bearing assembly having a sufficient lateral extent, hereafter designated as width W-LBA, to not only support the hot solids-gas separator 518 but to support as well the furnace 512, the backpass duct 520, the backpass volume 522, and the collection path 526. The load bearing assembly 540, in the embodiment of the circulating fluidized bed steam generator 510 shown in FIG. 7, is itself supported on appropriate conventional vertical supports, generally designated as vertical supports 542, at a height H-LBA which is above the height H-EXT of the exterior interface 532 of the gas outlet duct 530 of the hot solids-gas separator 518 and below the height H-SEP of the top surface of the hot solids-gas separator 518.

The support structure 538 is characterized by the absence of any load bearing members which support heat exchange surface at: (1) a height greater than the height H-EXT of the exterior interface 532 of the gas outlet duct 530 of the hot solids-gas separator 518 and (2) within a predetermined lateral spacing from the hot solids-gas separator 518. This predetermined lateral spacing from the hot solids-gas separator 518, hereafter designated as spacing SPA-MAX, extends laterally from the respective lateral side of the hot solids-gas separator 518 laterally opposite the chamber side face 534 thereof, hereafter designated as opposite face 544, and is of a magnitude no greater than the lateral extent or width W-SEP of the hot solids-gas separator 518. For example, with reference to the embodiment of the circulating fluidized bed steam generator 510 shown in FIG. 7, it can be seen that the only load bearing member which supports heat exchange surface within the predetermined lateral spacing SPA-MAX is the load bearing assembly 540, it being noted that the predetermined lateral spacing SPA-MAX is illustrated as equal to the lateral extent or width W-SEP of the hot solids-gas separator 518. The load bearing assembly 540 supports the backpass volume 522 a portion of which extends laterally beyond the opposite face 544 of the hot solids-gas separator 518 to a lateral extension spacing SPA-BV less than the predetermined spacing SPA-MAX. However, the embodiment of the circulating fluidized bed steam generator 510 shown in FIG. 7 is nonetheless characterized by the absence of any load bearing members which support heat exchange surface both (1) at a height greater than the height H-EXT of the exterior interface 532 of the gas outlet duct 530 of the hot solids-gas separator 518 and (2) within the predetermined lateral spacing SPA-MAX from the hot solids-gas separator 518. While the load bearing assembly 540 meets the criterion (2) in that it is "within the predetermined lateral spacing SPA-MAX from the hot solids-gas separator 518", the load bearing assembly 540 does meet the criteria (1) for the reason that none of the heat exchange surface of the backpass volume 522 is supported at a height greater than the height H-EXT of the exterior interface 532 of the gas outlet duct 530 of the hot solids-gas separator 518. Instead, all of the heat exchange surface of the backpass volume 522 supported by the load bearing assembly 540 is supported at a height lower than the height H-EXT of the exterior interface 530 of the gas outlet duct 530 of the hot solids-gas separator 518.

Figure 8:
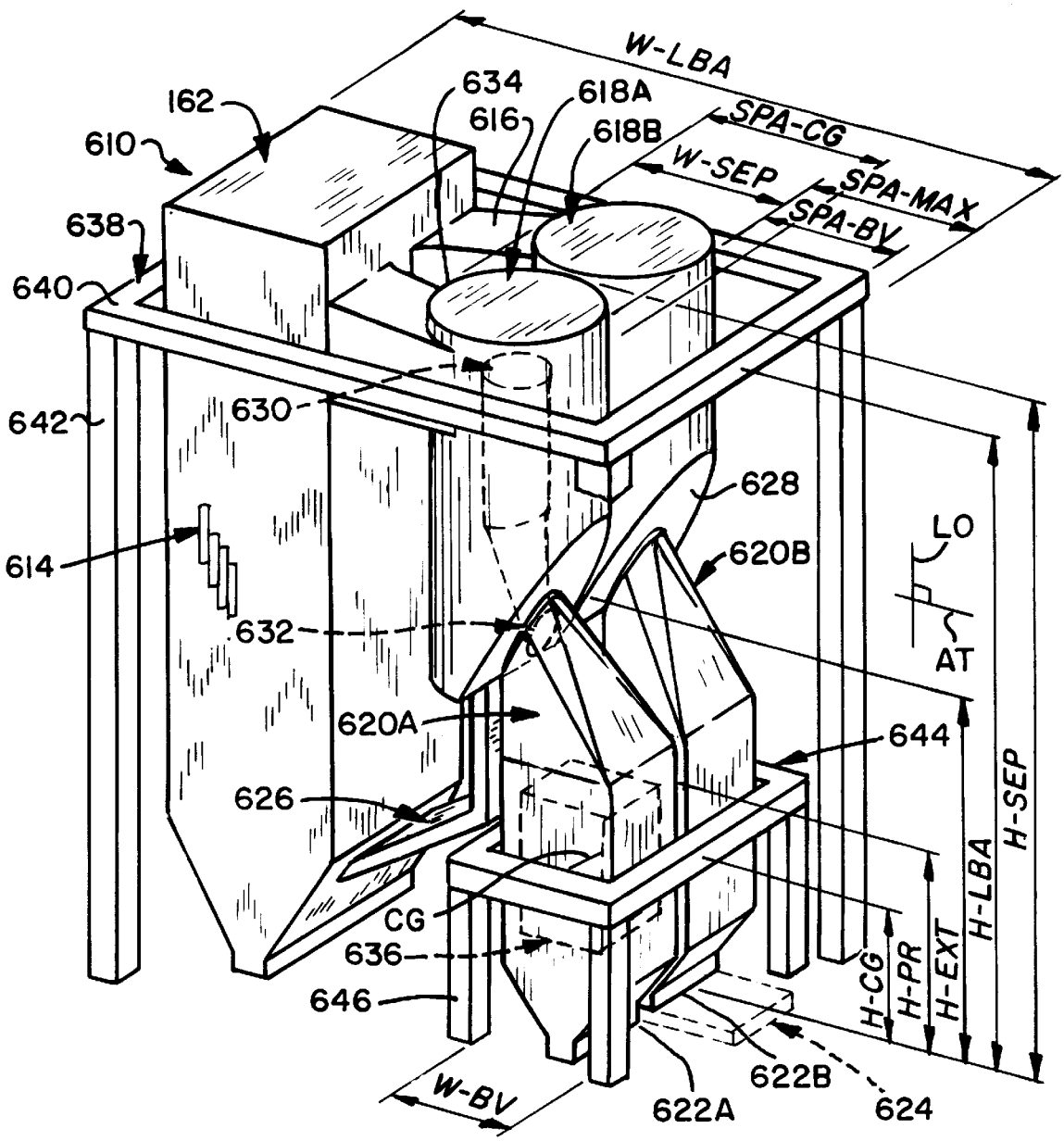
FIG. 8 is a perspective schematic view of a further embodiment of a circulating fluidized bed steam generator in accordance with the present invention.

FIG. 8 illustrates a further embodiment of a circulating fluidized bed steam generator in accordance with the present invention. The circulating fluidized bed steam generator, generally designated as 610, includes a furnace volume, denoted therein by the reference numeral 612, the latter being defined by waterwall tubes, denoted therein by the reference numeral 614; a first section of ductwork, denoted therein by the reference numeral 616; a pair of hot solids-gas separators, denoted therein by the reference numeral 618A and 618B, respectively; a pair of intermediate sections of backpass ductwork, denoted therein by the reference numeral 620A and 620B, respectively; and a pair of backpass volumes, denoted therein by the reference numeral 622A and 622B, respectively, from which further ductwork, denoted therein by the reference numeral 624, extends. The lower segment of each combined hot solids-gas separator 618A and 618B is connected in fluid flow relation with the lower segment of the furnace volume 612 through a fluid flow system consisting, in accordance with the illustration thereof in FIG. 8 of an initial collection path, denoted therein by the reference numeral 626.

Each combined hot solids-gas separator 618 is preferably configured as a cyclone assembly identical to the cyclone assembly 518 illustrated in FIG. 7. The separation chamber of each hot solids-gas separator 618A and 618B illustrated in FIG. 8 is operable to separate the combined gas-solids stream which flows into the cyclone assembly into a predominantly gas exit stream and a predominantly solids exit stream in a manner by which separated out solids to be discharged from the separation chamber via the predominantly solids exit stream are collected within the separation chamber at a location lower than the inlet of the hot solids-gas separator. The cylindrical wall portion of each hot solids-gas separator 618A and 618B merges into a downwardly sloping planar member 628 acting to urge the separated out solids to slide downwardly into the initial collection path 626, which is preferably in the form of a discharge chute.

Each hot solids-gas separator 618A and 618B also includes a gas outlet duct 630A and 630B, respectively, for outward flow of the predominantly gas exit stream out of the separation chamber. Each gas outlet duct 630A and 630B has an entrance within the separation chamber for the passage of the predominantly gas exit stream thereinto. Each gas outlet duct 630A and 630B has an extent from its entrance to at least an exterior interface 632A and 632"B, respectively, between the gas outlet duct and the separation chamber beyond which the gas outlet duct is communicated with the outside or exterior of the separation chamber. Each hot solids-gas separator 618A and 618B is disposed on one lateral side of the furnace 612, as viewed relative to a lateral axis AT, and has a chamber side face 634 in facing relation to the furnace 612. Each hot solids-gas separator 618A and 618B has a predetermined lateral extent, hereinafter designated as the width W-SEP, which is effectively equal to the diameter of its cylindrical wall portion and the furnace 612 has a predetermined lateral extent measured relative to the lateral axis AT. The top surface of each hot solids-gas separator 618A and 618B is at a height H-SEP, as measured in a longitudinal direction relative to a longitudinal axis LO perpendicular to the lateral axis AT. The height of the exterior interface 632 of each gas outlet duct 630A and 630B, as measured to the centerpoint of the circle formed by the intersection of the cylindrically shaped backpass ductwork 620 and the planar surface 628 of each hot solids-gas separator 618A and 618B, is less than the height H-SEP of the top surface of each hot solids-gas separator 618A and 618B and is generally designated as height H-EXT.

Each backpass volume 622A and 622B operates as a heat exchanger means for receiving cleaned gas from one of the hot solids-gas separator 618A and 618B, respectively. Each backpass volume 622A and 622B has a principal heat exchange region, generally designated as 636, defined by that portion of the backpass volume in which more than half [i.e., more than fifty percent (50%)] of its heat exchange duty is performed. In the embodiment of the circulating fluidized bed steam generator 610 shown in FIG. 8, the principal heat exchange region 636 of each backpass volume 622A and 622B is comprised of a plurality of parallelepiped shaped blocks of heat exchange surfaces of the backpass volume which collectively define an overall rectangular block shape having a predetermined lateral extent, designated as width W-BV, as measured relative to the lateral axis AT and a center of gravity CG located at the center of the rectangular block. In other configurations of the backpass volume which have an overall shape different than that of a rectangular block, the location of the center of gravity CG will necessarily be determined by the particular arrangement and individual masses of the heat exchange surfaces defining the overall shape of the backpass volume.

The center of gravity CG is at a lateral spacing SPA-CG from the chamber side face 634 of each hot solids-gas separator 618A and 618B in which the lateral spacing SPA-CG is no greater than one hundred and twenty five percent (125%) of the width W-SEP of each hot solids-gas separator 618A and 618B. This lateral spacing SPA-CG is most preferably between about fifty percent (50%) to about one hundred percent (100%) of the width W-SEP of each hot solids-gas separator 618A and 618B. For example, the lateral spacing SPA-CG of the center of gravity CG of each principal heat exchange region 636 shown in FIG. 8 is between fifty percent (50%) and seventy-five percent (75%) of the width W-SEP of each hot solids-gas separator 618A and 618B.

The center of gravity CG of the principal heat exchange region 636 has a height H-CG which is no higher than the height H-EXT of the exterior interface 632 of the gas outlet ducts 630A and 630B of the hot solids-gas separators 618A and 618B, respectively. The height H-CG of the center of gravity CG of the principal heat exchange region 636 is preferably between about twenty-five percent (25%) to about seventy five percent (75%) of the height H-EXT of the exterior interface 632 of the gas outlet ducts 630A and 630B. For example, the height H-CG of the center of gravity CG of the principal heat exchange region 636 of the embodiment of the circulating fluidized bed steam generator 610 shown in FIG. 8 is approximately fifty percent (50%) of the height H-EXT of the exterior interface 632 of the gas outlet duct 630. Also, in this embodiment, the height H-PR of the top surface of the principal heat exchange region 636 of each backpass volume is greater than the height H-CG of the center of gravity CG and less than the height H-EXT of the exterior interface 632 of the respective gas outlet duct 630A or 630B.

The circulating fluidized bed steam generator 610 also includes a support structure 638 for supporting the steam generator in its erected condition. The support structure 638 includes an upper level load bearing assembly 640 for supporting the pair of hot solids-gas separators 618A and 618B. The upper level load bearing assembly 640 is itself supported on appropriate conventional vertical supports, generally designated as vertical supports 642, at a height H-LBA which is above the height H-EXT of the exterior interfaces 632 of the gas outlet ducts 630A and 630B of the hot solids-gas separators 618A and 618B generally at the height H-SEP of the top surface of the hot solids-gas separators 618A and 618B.

The support structure 638 also includes a lower level load bearing assembly 644 for supporting the pair of backpass volumes 622A and 622B and this load bearing assembly is itself supported on conventional vertical support members 646.

The support structure 638 is characterized by the absence of any load bearing members which support heat exchange surface at: (1) a height greater than the height H-EXT of the exterior interface 632 of the gas outlet ducts 630A and 630B of the hot solids-gas separators 618A and 618B and (2) within a predetermined lateral spacing SPA-MAX from the hot solid-gas separators 618A and 618B. This predetermined lateral spacing SPA-MAX is of a magnitude no greater than the lateral extent or width W-SEP of a respective one of the hot solids-gas separators 618A or 618B.

Figure 9:
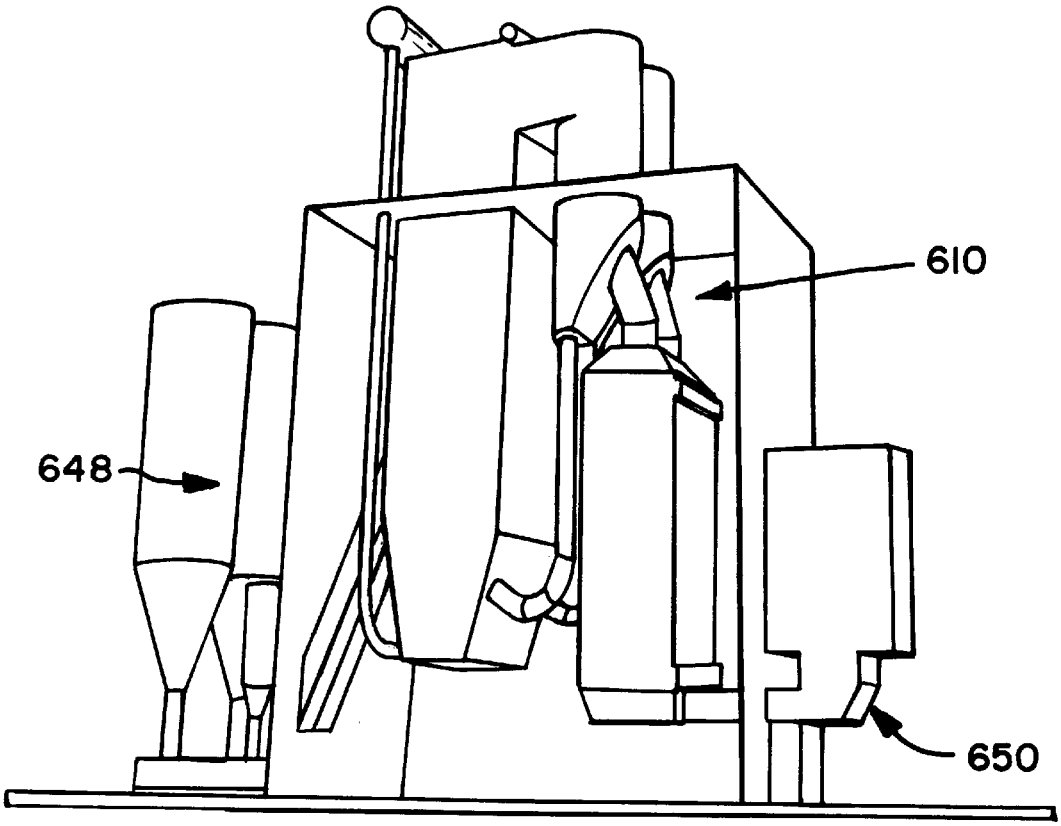
FIG. 9 is a perspective schematic view of an arrangement which includes the further embodiment of the circulating fluidized bed steam generator shown in FIG. 8 and other components such as a fuel and sorbent feed assembly and a particulate removal system for treating flue gas.

Reference is now had to FIG. 9 which exemplarily illustrates a steam generating arrangement which combines a steam generator of the present invention—here, the further embodiment of the steam generator illustrated in FIG. 8—with other components which are desirably or customarily interconnected to a circulating fluidized bed steam generator. The steam generating arrangement shown in FIG. 9 includes the steam generator 610, a fuel and sorbent supply assembly 648, and a particulate removal assembly 650 for removing particulates from cleaned flue gas which has exited the backpass volume 622.

While embodiments of the present invention have been shown, it will be appreciated that modifications thereof, some of which have been alluded to hereinabove, may still be readily made thereto by those skilled in the art. It is, therefore, intended that the appended claims shall cover the modifications alluded to herein as well as all the other modifications which fall within the true spirit and scope of the present invention.

We claim:

1. A steam generator for generating steam by the combustion of a fuel, comprising:

a combustion chamber;

a hot solids-gas separator having a gas outlet duct for outward flow of the predominantly gas exit stream out of the separation chamber, the gas outlet duct having at least one entrance within the separation chamber for the passage of the predominantly gas exit stream thereinto and the gas outlet duct having an extent from at least its entrance to an exterior interface between the gas outlet duct and the separation chamber beyond which the gas outlet duct is communicated with an area exterior of the separation chamber, the separator being disposed on one lateral side of the combustion chamber and having a chamber side face in facing relation to the combustion chamber, the chamber and the separator each having a predetermined lateral extent;

heat exchanger means for receiving cleaned gas which has exited the hot solids-gas separator through the gas outlet duct, the heat exchanger means having a principal heat exchange region defined by that portion of the heat exchanger means in which more than half of the heat exchange duty of the heat exchange means is performed, the principal heat exchange region having a predetermined lateral extent and a center of gravity and the center of gravity being at a lateral spacing from a chamber side face of the hot solids-gas separator no greater than one hundred and twenty five percent (125%) of the predetermined lateral extent of the hot solids-gas separator and having a height as measured in a longitudinal direction perpendicular to the lateral direction no higher than the exterior interface of the gas outlet duct of the hot solids-gas separator; and a support structure for supporting the steam generating apparatus, the support structure including a load bearing assembly for supporting the hot solids-gas separator and the support structure being characterized by the absence of any load bearing members for supporting heat exchange surface which support heat exchange surface (a) at a height greater than the height of the exterior interface of the gas outlet duct of the hot solids-gas separator and (b) within a predetermined lateral extent extending from a location on the hot solids-gas separator laterally opposite the chamber side face thereof to a width no greater than the lateral extent of the hot solids-gas separator.

2. The steam generator according to claim 1 wherein the hot solids-gas separator includes:

a plurality of wall portions forming a separation chamber and an inlet for passage of a combined gas-solids stream into the separation chamber, the lowermost extent of the inlet forming a threshold over which the combined gas-solids stream flows in entering the separation chamber and the separation chamber being operable to separate the combined gas-solids stream into a predominantly gas exit stream and a predominantly solids exit stream in a manner by which separated out solids to be discharged from the separation chamber via the predominantly solids exit stream are collected within the separation chamber at a location lower than the inlet;

a separated solids discharge for the discharge therethrough of the predominantly solids exit stream having the collected separated out solids therein; and the gas outlet duct being operable to exert a vortex effect capable of drawing gas into the gas outlet duct, and the threshold of the separation chamber inlet being relatively higher than the exterior interface of the gas outlet duct and the separation chamber and relatively lower than the entrance of the gas outlet duct.

3. A steam generator according to claim 2 wherein the extent of the gas outlet duct is substantially without openings below the entrance so as to effectively preclude the entrance of gas into the gas outlet duct below the entrance.

4. A steam generator according to claim 2 wherein the entrance of the gas outlet duct is formed by a selective barrier portion extending from the gas outlet duct to one of the wall portions of the separation chamber.

5. A steam generator according to claim 4 wherein the selective barrier portion has a peripheral extent formed by a plurality of spaced apart slats with each adjacent pair of slats forming an opening therebetween.

6. A steam generator according to claim 2 wherein one of the wall portions forming the separation chamber is disposed at a spacing from and above the entrance of the gas outlet duct and further comprising a vortex enhancement element extending from the one wall portion toward the gas outlet duct and having a peripheral extent substantially aligned and compatibly dimensioned with the peripheral extent of the gas outlet duct, whereby the vortex enhancement element cooperates with the gas outlet duct to promote the formation of a vortex action within the gas outlet duct.

7. A steam generator according to claim 2 wherein the separation chamber inlet includes an upper surface in opposition to, and spaced from, its threshold, and the entrance of the gas outlet duct is located no higher than the upper surface of the separation chamber inlet.

8. A steam generator according to claim 2 wherein the separation chamber inlet includes an upper surface in opposition to, and spaced from, its threshold, and the entrance of the gas outlet duct is located relatively higher than the upper surface of the separation chamber inlet.

9. A steam generator according to claim 8 wherein one of the wall portions forming the separation chamber is disposed at a spacing from and above the entrance of the gas outlet duct and the entrance of the gas outlet duct is located at a height differential above the threshold of the separation chamber inlet which is at least one half of the height differential between the one wall portion above the entrance of the gas outlet duct and the threshold of the separation chamber inlet.

* * * * *